US005394591A

United States Patent [19]

Jornot et al.

[11] Patent Number: 5,394,591

[45] Date of Patent: * Mar. 7, 1995

[54] AUTOLEVELLER DRAFTING ARRANGEMENT WITH MASS FLUCTUATION CONTROL

[75] Inventors: Erich Jornot; Urs Keller, both of Seuzach, Switzerland

[73] Assignee: Maschinenfabrik Rieter AG, Winterthur, Switzerland

[ * ] Notice: The portion of the term of this patent subsequent to Aug. 4, 2009 has been disclaimed.

[21] Appl. No.: 765,570

[22] Filed: Sep. 25, 1991

[30] Foreign Application Priority Data

Sep. 26, 1990 [CH] Switzerland ..... 3100/90

[51] Int. Cl.[6] ..... D01H 5/38; G01D 3/04

[52] U.S. Cl. ..... 19/240; 364/470

[58] Field of Search ..... 19/105, 0.23, 150, 236, 19/239, 240, 258, 260, 268, 270, 271; 364/470; 226/10, 24, 40, 122

[56] References Cited

U.S. PATENT DOCUMENTS

| | | | |
|---|---|---|---|
| 2,930,084 | 3/1960 | Sanborn et al. | 19/240 |
| 2,950,508 | 8/1960 | Locher | 19/240 |
| 3,088,175 | 5/1963 | Aoki | 19/240 |
| 3,099,048 | 7/1963 | Locher | 19/240 |
| 3,925,850 | 12/1975 | Lytton | 19/240 X |
| 3,958,305 | 5/1976 | Felix et al. | 19/240 X |
| 4,038,723 | 8/1977 | Felix | 19/240 X |
| 4,163,927 | 8/1979 | Grice, Jr. | 19/240 X |
| 4,336,684 | 6/1982 | Hartmannsgruber et al. | 19/240 X |
| 4,473,924 | 10/1984 | Hartmannsgruber et al. | 19/240 X |
| 4,494,204 | 1/1985 | Hösel | 19/240 X |
| 4,506,414 | 3/1985 | Kreiger | 19/240 |
| 4,512,061 | 4/1985 | Hartmannsgruber et al. | 19/239 |
| 4,539,729 | 9/1985 | Meile et al. | 19/288 |
| 4,589,168 | 5/1986 | Krieger | 19/240 |
| 4,653,153 | 3/1987 | Felix et al. | 19/240 |
| 4,703,431 | 10/1987 | Sako et al. | 19/240 X |
| 4,791,706 | 12/1988 | Wiening et al. | 19/105 |
| 4,812,993 | 3/1989 | Konig et al. | 19/239 X |
| 4,819,301 | 4/1989 | Konig et al. | 19/240 |
| 4,864,694 | 9/1989 | Konig et al. | 19/240 |
| 4,974,296 | 12/1990 | Vidler | 19/239 |
| 4,987,734 | 1/1991 | Meyer | 19/236 X |
| 5,134,755 | 8/1992 | Jornot et al. | 19/239 |

FOREIGN PATENT DOCUMENTS

| | | | |
|---|---|---|---|
| 0176661 | 4/1986 | European Pat. Off. . | |
| 0340756 | 11/1989 | European Pat. Off. . | |
| 2521597 | 8/1983 | France | D01H 5/38 |
| 3622584 | 1/1988 | Germany | D01H 5/38 |
| 0672928 | 1/1990 | Switzerland . | |
| 0824070 | 11/1959 | United Kingdom | 19/240 |
| 2061338 | 5/1981 | United Kingdom | 19/239 |
| 2062712 | 5/1981 | United Kingdom | 19/260 |
| 2081758 | 2/1982 | United Kingdom | 19/105 |

OTHER PUBLICATIONS

PTO Forms 1449 and 892 from United States Application No. 07/566,627.

PTO Forms 1449 and 892 from United States Application No. 07/552,491.

*Primary Examiner*—Clifford D. Crowder
*Assistant Examiner*—Ismael Izaguirre
*Attorney, Agent, or Firm*—Sandler Greenblum & Bernstein

[57] ABSTRACT

The autoleveller drafting arrangement comprises measuring elements for the throughpassing quantity of textile fibers both at the inlet end and the outlet end thereof. There is provided a system which at least in part is self-adjusting, in order to take account of measuring errors, and thus, to obtain an improved self-adjusting optimization of control and regulation parameters.

19 Claims, 5 Drawing Sheets

D
2
2.3
2.2
2.1
16
9.1
V2
V1
1
Vin
1.2
1.1
15.1-15.6
3
11
3.2
17
V4
4.2
4
4.3
12
5.2
5
18
6
V6
6.2
Vout
13
V3
3.1
4a
4.1
5.1
V5
9.2
6.1
18'
7a
7a
7b
7b
9b
DRIVE
7.3
DRIVE
7.1
DRIVE
7.2
8b
8a
8e
8d
8c
REGULATOR
8.1
8.2
REGULATOR
10a
10b
10
9a
CENTRAL COMPUTER UNIT
V1 = V2 < V3 = V4 < V5 = V6

AUTOLEVELLER DRAFTING ARRANGEMENT WITH MASS FLUCTUATION CONTROL

CROSS REFERENCE TO RELATED APPLICATIONS

This application claims the priority of Swiss Application No. 03 100/90-4, filed Sep. 26, 1990, the disclosure of which is incorporated herein by reference in its entirety.

This application is also related to commonly assigned U.S. application Ser. No. 07/566,627, filed Aug. 13, 1990, now abandoned, the disclosure of which is incorporated in its entirety herein by reference. This application is also related to commonly assigned U.S. application Ser. No. 07/552,491, filed Jul. 16, 1990, now abandoned, the disclosure of which is incorporated herein by reference in its entirety.

This application is related to the commonly assigned, copending U.S. application Ser. No. 07/729,328, filed Jul. 12, 1991, now abandoned, and entitled "Drive for a Drafting Arrangement", the disclosure of which is incorporated in its entirety herein by reference.

BACKGROUND OF THE INVENTION

1. Field of the Invention

The present invention relates broadly to textile machines containing drafting arrangements, and, more specifically, to a new and improved autoleveller drafting arrangement and to a method of operating such autoleveller drafting arrangement.

An autoleveller drafting arrangement is a drafting arrangement at which there can be altered in a controlled or regulated manner the draft of the textile material, in order to even out mass fluctuations at a drafted sliver. Such drafting arrangements are frequently used in so-called autolevelling systems in short staple fiber spinning mills, but also can be employed at cards, combing machines and combing preparatory machines in short staple fiber spinning mills. Of course, the same principles are also suitable for use in long staple fiber spinning mills.

2. Background Art

The principles of control and regulation technology have been applied for several decades to autoleveller drafting arrangements. As a result, it was possible to continually improve the quality of the processed slivers to the extent that such quality was governed solely by the uniformity of the mass per unit length of the sliver.

Throughout the same time frame intensive efforts were expended to provide a clear definition of the expression "quality" in respect of uniformity or evenness of the sliver. These efforts resulted in generally accepted testing methods and the attendant availability of suitable testing equipment.

With the aid of the previously employed technology in conjunction with a quality-oriented organization of the spinning mill it is now possible for every spinning mill to avoid or correct most of the relatively coarse errors or defects and to fabricate slivers of good average quality.

Because of the increasing demands imposed upon the quality of the slivers it is necessary to now again further augment this good quality level or performance. However, when attempting to do so one is confronted with a technical area where it is no longer sufficient to merely apply the basic principles of control and regulation technology or the basic principles of statistical quality control in the spinning mill. To achieve a further appreciable increased quality improvement it is now necessary to more fully explore the intimate interaction of the measuring principles, the control and regulation principles, drive systems, drafting forces and textile material properties. In embarking in this direction it is always important to keep in mind the principles of testing for the uniformity of textile slivers which have previously been defined by prevailing predetermined standards.

The control of the sliver quality in the spinning mill is presently extensively undertaken in the laboratory, in other words, so-to-speak "off-line". For this purpose random samples are taken from the processing line, delivered to the laboratory and there checked. The test results are supposed to provide conclusions regarding setting of the machines and to render possible accommodation of the textile material to be processed to the requirements of the final product.

Sufficient time is available in the laboratory, in other words, off-line, to analyze the different information or data, to reach a suitable interpretation of the different results and to draw corresponding conclusions. If attempts are made to utilize such methods "on-line" during normal operation, where interventions should be correctively undertaken in the process based upon the just determined measurement values, it should not be surprising that a real danger exists of reaching faulty or deceptive conclusions. The control and regulation system erroneously interprets the available measurement data and correspondingly incorrectly intervenes in the process.

An attempt at overcoming such a problem has been disclosed in European Patent No. 176,661, Apr. 9, 1986 and the corresponding U.S. Pat. No. 4,653,153, granted Mar. 31, 1987. According to the therein contained proposal brief mass fluctuations of the incoming fiber sliver are evened out by a control which governs the drafting operation. In this connection, two control parameters can be controllably accommodated, namely, the amplification and the time shift or delay. The results of the controlled change in the drafting of the sliver are determined by monitoring the sliver at the outlet or delivery side or end of the drafting arrangement, so that the aforementioned two control parameters can be optimized based upon monitoring of the results. As far as this proposal is concerned from the standpoint of the control and regulation technology, it can not be criticized. However, it is insufficient for achieving the desired improvement in the quality of the sliver because it fails to take into account technological problems, particularly those arising in respect of the measurements and processing of the sliver. Additionally, this proposal is predicated upon the evaluation of momentarily obtained measurement results and intervening in the process, which occurs either immediately or after a simple time delay. The "history" or background of this method is not explored. Comparable concepts are disclosed in Swiss Patent No. 672,928, granted Jan. 15, 1990 and the cognate U.S. Pat. No. 4,819,301, granted Apr. 11, 1989.

A further proposal entailing a "deeper" surveillance of the method is disclosed in European Patent No. 340,756, published Nov. 8, 1989. According to a first embodiment of such proposal, there should be determined threshold values of the signal delivered by the outlet measuring element, and upon exceeding a threshold value there is triggered an alarm and the machine can be shutdown. When that situation occurs the operator is supposed to check the product, in other words, the delivered fiber sliver. As a function of the results derived from such sliver checking operation conclusions should be drawn concerning measurement errors and regulation errors.

A second embodiment of the same proposal contemplates establishing threshold values for the setting or adjustment signal which governs the drafting operation. Here too, upon exceeding a threshold value there is triggered an alarm and the machine is shutdown. In this case, the fiber sliver is checked by an operator. As a function of the checking results conclusions are drawn concerning errors in the inlet measuring system or in the production of the feed material or supply stock, that is, at the production machines upstream of such drafting arrangement.

Monitoring of the measurement signal of the outlet measuring system can furnish certain data regarding faulty or erroneous functions. However, this measure on its own is insufficient to obtain an appreciable improvement in the quality of the sliver. The monitoring of the adjustment signal, as proposed in the aforementioned European Patent No. 340,756, in conjunction with sounding an alarm and shutting down the machine, hardly provides any advantages. Until such time as the operator has checked the sliver the faulty sliver has already been processed (corrected) by the drafting arrangement, so that there is no longer available significant data or information concerning the sliver defect. Since the monitoring operation is set to merely detect a short-time (possibly seldom) fault occurrence or "runaway" situation, the piece or section of the sliver to be examined by the operator no longer contains a corresponding "event", so that again there exists the risk of reaching a deceptive conclusion.

In the commonly assigned, U.S. application Ser. No. 07/566,627, filed Aug. 13, 1990, and entitled "Method and Apparatus for Controlling a Drafting Unit", the disclosure of which is incorporated in its entirety herein by reference, there is disclosed a further developed system which can better take into account, in particular technological measurement problems during determining the high frequency part of the mass fluctuations at the inlet side or end of the drafting arrangement.

SUMMARY OF THE INVENTION

Therefore, with the foregoing in mind, it is a primary object of the present invention to provide an improved construction of autoleveller drafting arrangement and method of operating such autoleveller drafting arrangement which are not afflicted with the aforementioned shortcomings and drawbacks of the prior art.

Another and more specific object of the present invention aims at further developing autoleveller drafting arrangements in such a manner that the interactions decisive for operation of such autoleveller drafting arrangements can be taken into even better account than considered in the aforementioned U.S. application Ser. No. 07/566,627.

Therefore, the present invention contemplates the provision of an autoleveller drafting arrangement for slivers, which is equipped with an outlet measuring element, at least one drafting zone, a drive system and a control or regulation system (sometimes simply generically or broadly referred to herein as a regulation system) for the drive system. This control or regulation system responds to a measurement signal delivered by the outlet measuring element, so that by means of the drive system the drafting of the textile material in the drafting zone can be changed in such a manner that mass fluctuations in the feed sliver are corrected.

Importantly, the autoleveller drafting arrangement of the present development is manifested, among other things, by the features that the measurement signal of the outlet measuring element is adjusted as a function of the operating conditions in order to compensate effects exerted upon the measurement result due to such operating conditions.

One such operating condition or more specifically, one such operational parameter, is the degree of drafting exerted upon that section of the sliver which is responsible for the measurement signal. A further such operating condition or operational parameter, is the delivery velocity or speed of the sliver.

Stated in a somewhat different fashion, the present invention provides an autoleveller drafting arrangement for slivers having an inlet side and an outlet side, which comprises:

means providing at least one drafting zone for drafting textile material originating from at least one feed sliver to form a drafted sliver;

drive means for the at least one drafting zone;

an outlet measuring element for measuring the drafted sliver and delivering a measurement signal as a result of the measuring of the drafted sliver in order to provide a measurement result;

regulation means for regulating the drive means;

the regulation means being operatively connected with the outlet measuring element and responsive to the measurement signal delivered by the outlet measuring element for regulating the drive means such that the drafting of the textile material in the drafting zone can be changed in such a manner that mass fluctuations in the at least one feed sliver are corrected; and said regulation means adjusting the measurement signal of the outlet measuring element as a function of at least one operating condition prevailing at the drafting arrangement in order to compensate effects exerted upon the measurement result due to the at least one operating condition.

Still further, the inlet measuring element can be responsive to both the mass of the textile material delivered from the inlet side of the drafting arrangement and to a quantity of at least one medium or substance entrained by the textile material, such as the moisture content of the textile material or the air entrained between the fibers of the textile material.

A further aspect of the present invention entails providing means for obtaining from the inlet measuring element a measurement signal comprising two signal components composed of respective signal component pairs, wherein each respective signal component pair is unambiguously correlatable to a predeterminable quantity of fibers of the textile material, and means for correlating signal component pairs to quantities of fibers of the drafted sliver determined by the outlet measuring element while taking into account the action of the at least one drafting zone upon the mass of the fibers of the textile material located between the inlet measuring element and the outlet measuring element.

As alluded to above, the invention is furthermore directed to a method of operating an autoleveller drafting arrangement for slivers having an inlet side and an outlet side, which comprises the steps of:

drafting textile material in at least one drafting zone to form a drafted sliver;

employing an outlet measuring element for measuring the drafted sliver and delivering an output measurement signal representative of the fiber mass of the drafted sliver and air entrained by the fiber mass of the drafted sliver;

regulating drive means of the at least one drafting zone by regulation means responsive to the output measurement signal delivered by the outlet measuring element such that the drafting of the textile material in the drafting zone can be changed in such a manner that mass fluctuations in the textile material originating from one or more feed slivers are corrected;

adjusting the output measurement signal of the outlet measuring element by the regulation means as a function of at least one operating condition prevailing at the drafting arrangement in order to compensate effects exerted upon the measurement result due to the at least one operating condition; and accomplishing the step of adjusting the output measurement signal of the outlet measuring element as a function of at least one operating condition prevailing at the drafting arrangement prior to employing the outlet measuring element for measuring the drafted sliver and delivering the output measurement signal representative of the fiber mass of the drafted sliver and the air entrained by the fiber mass of the drafted sliver.

As to a further method of operating an autoleveller drafting arrangement for slivers having an inlet side and an outlet side, there are contemplated the steps of:

passing textile material through an inlet measuring element responsive to the fiber quantity of the textile material delivered from the inlet side of the drafting arrangement;

obtaining from the inlet measuring element a measurement signal comprising two signal components composed of respective signal component pairs;

each respective signal component pair being unambiguously correlatable to a predeterminable quantity of fibers of the textile material;

drafting the textile material in at least one drafting zone to form a drafted sliver;

measuring the drafted sliver by means of an outlet measuring element and delivering a measurement signal as a result of the measuring of the drafted sliver in order to provide a measurement result; and correlating the signal component pairs to quantities of fibers of the drafted sliver determined by the outlet measuring element while taking into account the action of the at least one drafting zone upon the mass of the fibers of the textile material located between the inlet measuring element and the outlet measuring element.

BRIEF DESCRIPTION OF THE DRAWINGS

The invention will be better understood and objects other than those set forth above, will become apparent when consideration is given to the following detailed description thereof. Such description makes reference to the annexed drawings, wherein there have been generally used the same reference characters to denote the same or analogous components throughout the various figures of the drawings. Moreover, to enhance the understanding of the invention the description and drawings also will make reference to prior systems disclosed in earlier patent applications of the present assignee in order to provide background information, and wherein.

DESCRIPTION OF THE PREFERRED EMBODIMENTS

Describing now the drawings, it is to be understood that only enough of the construction of the autoleveller drafting arrangement and related structure have been depicted therein, in order to simplify the illustration, as needed for those skilled in the art to readily understand the underlying principles and concepts of the present invention.

Figure 1:
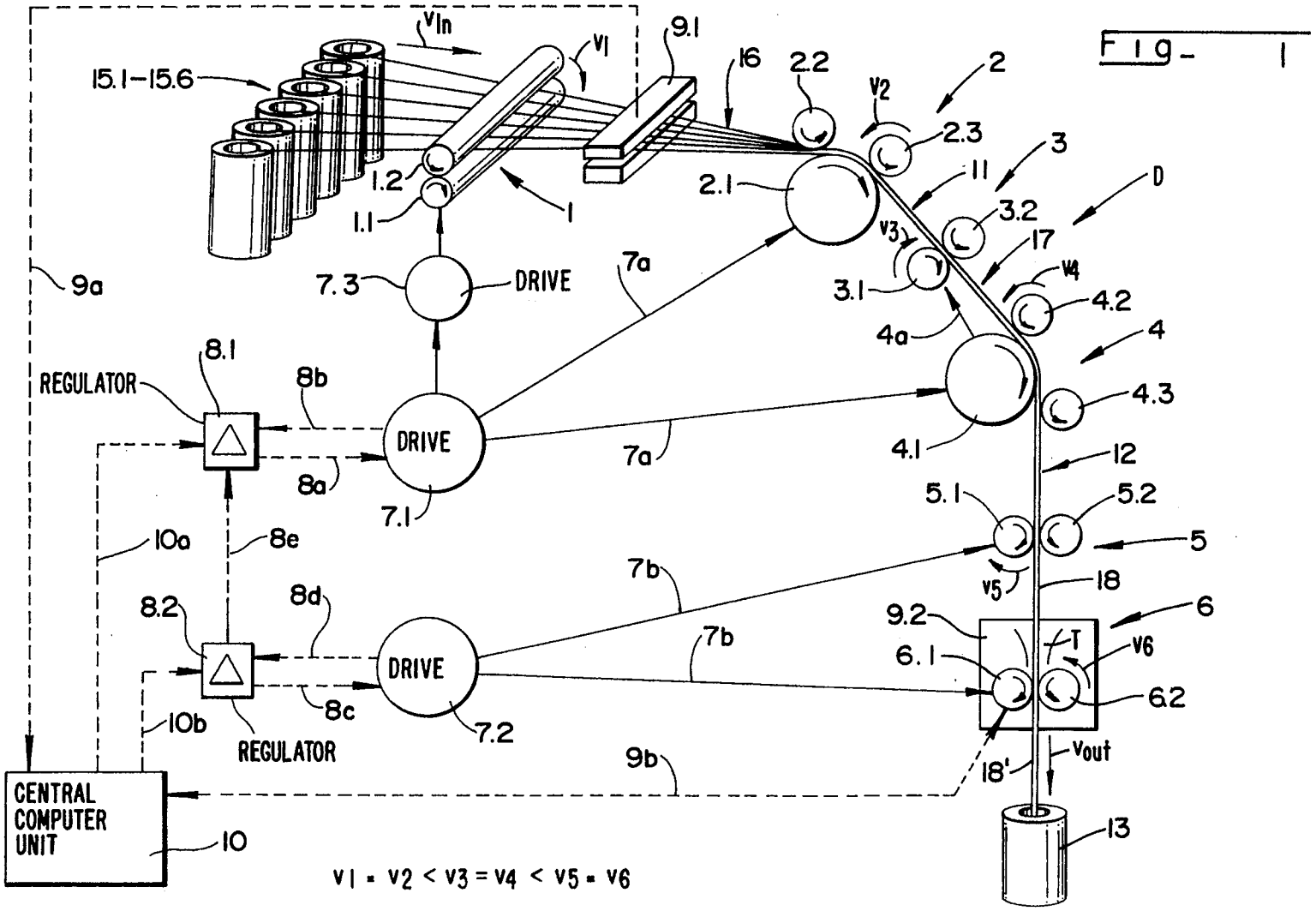
FIG. 1 schematically illustrates a drafting arrangement containing a preliminary drafting zone or region and a main drafting zone or region and the principle measuring devices in general correspondence with the system disclosed in the commonly assigned, U.S. application Ser. No. 07/552,491, filed Jul. 16, 1990, and entitled "Drafting Arrangement With Feedback Drive Groups", the disclosure of which is incorporated in its entirety herein by reference.

In FIG. 1 there is schematically depicted an exemplary embodiment of drafting arrangement D of a textile machine, such as a draw frame. A plurality of slivers 15.1 to 15.6, in the embodiment under discussion, for instance, six slivers, are delivered in juxtaposed relationship through a plurality of roller systems 1, 2, 3, 4, 5 and 6. Since the peripheral or circumferential velocity of the rollers of such roller systems 1, 2, 3, 4, 5 and 6 increases in two stages in the travel or transport direction of the fiber material, as will be further considered shortly, the fiber material experiences a pre-draft (preliminary draft) in the first stage and is subjected to further drafting (the main draft) in the second stage so as to possess the desired cross-section or cross-sectional area. The web 18 issuing from the drafting arrangement D is thinner than the web formed by the infed slivers 15.1 to 15.6 and correspondingly longer. Since the drafting operations can be regulated as a function of the cross-section of the infed slivers 15.1 to 15.6, these slivers and, more specifically, the resultant web is evened out during its passage through the drafting arrangement D.

The drafting arrangement D depicted in FIG. 1 specifically will be seen to comprise a preliminary drafting zone or region 11 and a main drafting zone or region 12. It is to be expressly understood that the teachings of the present invention can be, of course, employed in analogous manner in conjunction with drafting arrangements having only one or more than two drafting zones or regions, Continuing, it will be observed the infed slivers 15.1 to 15.6 are delivered into the drafting arrangement D by the two roller systems 1 and 2 comprising, for example, conveyor or transport rolls 1.1, 1.2 and 2.1, 2.2 and 2.3, respectively. The infed slivers 15.1 to 15.6 grouped or gathered together into a loose fleece or web are transported through the first roller system 1 which comprises, for instance, the just mentioned two rolls or rollers 1.1 and 1.2. Arranged downstream of the first roller system 1, as viewed with respect to the predetermined direction of travel of the slivers 15.1 to 15.6, is the second roller system 2, here comprising an active or driven conveying or transport roll or roller 2.1 and two passive or non-positively driven conveying or transport rolls or rollers 2.2 and 2.3. During the infeed of the slivers 15.1 to 15.6 through the roller systems 1 and 2 the infed slivers 15.1 to 15.6 are grouped together adjacent one another to form the composite web 16. The peripheral velocities $v_1$ and $v_2$ (equal to $v_{in}$) of all of the rolls 1.1, 1.2 and 2.1, 2.2 and 2.3 of both of the roller systems 1 and 2 of this textile material infeed structure are of approximately the same magnitude, so that the thickness of the web 16 corresponds to the thickness of the infed slivers 15.1 to 15.6.

A third roller system 3 follows, in the predetermined direction of travel of the web 16, the first and second roller systems 1 and 2 of the previously considered textile material infeed structure. This third roller system 3 comprises the preliminary or pre-draft rolls or rollers 3.1 and 3.2. between which the web 16 is further transported. The peripheral velocity $v_3$ of the preliminary draft rolls 3.1 and 3.2 is greater than the peripheral velocities $v_1$ and $v_2$ of the rolls 1.1 and 1.2 of the roller system 1 and the rolls 2.1, 2.2 and 2.3 of the roller system 2. Consequently, the web 16 is drafted between the transport or infeed rolls 2.2 and 2.3 of the roller system 2 and the preliminary draft rolls 3.1 and 3.2 of the roller system 3 in the preliminary drafting zone 11, and the cross-section of such web 16 is reduced. At the same time, there is formed from the loose web 16 of the infed slivers 15.1 to 15.6 a preliminary or pre-drafted web 17.

A further or fourth roller system 4 follows the roller system 3 containing the preliminary draft rolls 3.1 and 3.2 in the predetermined direction of travel of the preliminary drafted web 17. This further roller system 4 comprises, for example, an active or driven roll or roller 4.1 and two passive or non-positively driven rolls or rollers 4.2 and 4.3 for the further transport of the web 17. The peripheral velocity $v_4$ of these transport or conveying rolls 4.1, 4.2 and 4.3 of the roller system 4 is the same as the peripheral velocity $v_3$ of the preliminary draft rolls 3.1 and 3.2 of the roller system 3.

A fifth roller system 5 containing the main draft rolls 5.1 and 5.2 follows the fourth roller system 4 in the predetermined direction of travel of the web 17. Once again, these main draft rolls 5.1 and 5.2 have a greater peripheral velocity $v_5$ than the peripheral velocity $v_4$ of the upstream located transport or conveying rolls 4.1, 4.2 and 4.3 of the fourth roller system 4, so that the preliminary drafted web 17 is further drafted in the main drafting zone 12, between the rolls 4.1, 4.2 and 4.3 and the main draft rolls 5.1 and 5.2, in order to form the finished or final drafted sliver 18. This finally drafted web 18 is condensed or gathered together by the condenser or funnel T to form a sliver 18'.

The finally drafted sliver 18' is removed from the drafting arrangement D by a roller pair 6 composed of the delivery or outfeed rolls or rollers 6.1 and 6.2 having a peripheral velocity $v_6$ ($v_{out}$) which is equal to the peripheral velocity $v_5$ of the upstream located main draft rolls 5.1 and 5.2. The removed sliver 18' is deposited, for example, into rotating sliver cans 13.

The roller systems 1, 2 and 4 are driven by a first drive motor or drive 7.1 by means of a suitable transmission, preferably toothed belts, generally indicated by reference numeral **7*a*. The preliminary draft rolls 3.1 and 3.2 of the roller system 3 are mechanically coupled, as schematically indicated by the coupling line 4*a*, with the roller system 4, specifically, for example, with the driven roll or roller 4.1 thereof, and the transmission ratio can be adjusted relative to the roller systems 1 and 2 or there can be preset a reference or set value. The transmission (not shown in detail in the drawing) determines the ratio between the peripheral velocities $v_{in}$, that is the peripheral velocities $v_1$ and $v_2$ of the rolls 1.1, 1.2 and 2.1, 2.2 and 2.3 of both of the roller systems 1 and 2 and the peripheral velocity $v_3$ of the preliminary draft rolls 3.1 and 3.2 of the roller system 3 together with the preliminary drafting ratio. The infeed or transport rolls 1.1 and 1.2 of the roller system 1, as explained above, can be driven by the first drive motor 7.1 or else, if desired, directly by an independent drive motor 7.3**.

The roller systems 5 and 6 are driven by a second drive motor or drive 7.2 through the action of a suitable transmission, again preferably toothed belts, generally indicated by reference numeral **7*b*. According to the invention, both of the drive motors or drives 7.1 and 7.2 have operatively associated therewith their own regulator or controller 8.1 and 8.2, respectively. The regulation or control operation is accomplished by a respective closed regulation circuit 8*a*, 8*b* and 8*c*, 8*d* provided for the regulators or controllers 8.1 and 8.2, respectively. Additionally, the actual value of any one drive motor 7.1 or 7.2 can be transmitted in one or the other direction to the other drive motor 7.2 or 7.1 by a control connection 8*e* interconnecting the regulators or controllers 8.1 and 8.2, so that each such drive motor 7.1 and 7.2** can appropriately respond to reference or set value deviations of the other drive motor.

At the inlet side or input side of the drafting arrangement D the entire cross-section or cross-sectional area of the infed slivers 15.1 to 15.6 is measured by an inlet measuring or measurement element or means 9.1. At the outlet side or end of the drafting arrangement D the cross-section or cross-sectional area of the emerging sliver 18 is measured by an outlet measuring or measurement element or means 9.2.

A central computer unit 10 transmits an initial setting of the reference or set value for the first drive motor or drive 7.1 by means of the connection or transmission line **10*a* to the first regulator 8.1. The measurement or measuring values of both of the measuring elements 9.1 and 9.2 are continuously transmitted during the drafting operation by means of the connection or transmission lines 9*a* and 9*b* to the central computer unit 10. The reference or set value for the second drive motor or drive 8.2 is determined by the central computer unit 10 and possibly provided further elements according to the invention from these measurement values or results and from the reference or set value for the cross-section of the emerging sliver 18'. This reference or set value is continuously inputted by the connection or transmission line 10*b* to the second regulator 8.2. By means of this regulation system it is possible to compensate fluctuations in the cross-sections of the infed slivers 15.1 to 15.6** by appropriately regulating the main drafting operation and to achieve evening of the processed sliver.

The regulators or controllers in the auxiliary regulation are advantageously position regulators or controllers (not rotational speed regulators), since such position regulators or controllers permit carrying out the regulation operation also in the event of standstill of a drive motor. The corresponding regulators 8.1 and 8.2 (and possible further regulators as contemplated according to a variant embodiment) can contain separate computer units (for example, having digital computer elements; microprocessors) or, however, can be designed as modules of the central computer unit 10.

In the description to follow there will be more fully explained the measurement principle. In the illustrated exemplary embodiment relating to an autoleveller drafting arrangement D, the objective is to produce a constant or essentially constant preliminary draft. The sliver cross-section is controlled and equalized substantially by varying the draft in the main drafting zone 12. The inlet measuring element 9.1 delivers the inlet-side measuring signal containing information about the cross-section of the infed slivers 15.1 to 15.6.

Figure 2:
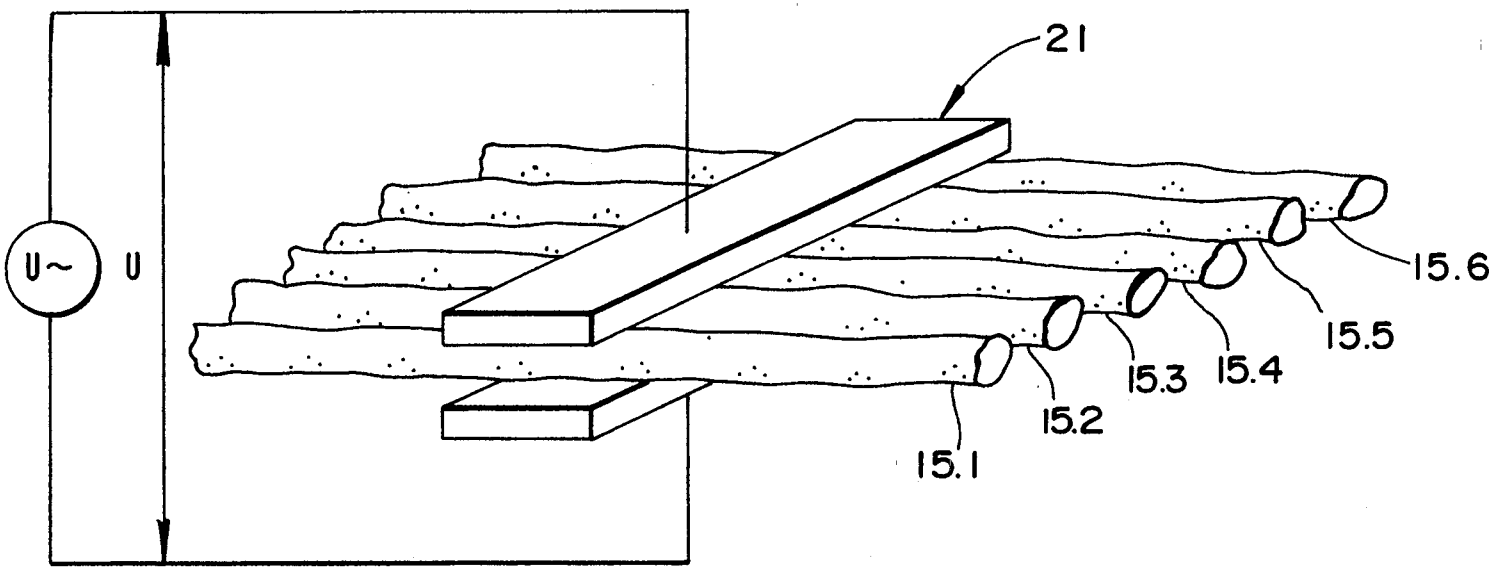
FIG. 2 illustrates a measuring transducer constituting the inlet measuring element of the drafting arrangement depicted in FIG. 1.

As is known in this art, there are difficulties associated with measuring technology in obtaining the desired inlet measuring signal. It is exceedingly difficult to measure in conventional manner the cross-section of the sliver without adversely affecting the textile material and at a high dynamic level. Consequently, the measurement has to be indirect, using a transducer. Various conventional transducers are inadequate for the desired purpose. Therefore, in connection with the present invention use is made of a measuring capacitor 21 as shown in FIG. 2, through which travel the infed slivers 15.1 to 15.6. There is utilized the principle that the dielectric is altered by fluctuations in the fiber mass of the slivers travelling between the capacitor plates.

When the slivers 15.1 to 15.6 run through capacitor 21 and with an applied alternating-current voltage U, information about the dielectric can be obtained by measuring the voltage U across the capacitor 21. It is to be observed that the measurement, however, may be considerably affected by the moisture content of the slivers 15.1 to 15.6 and other disturbances or factors. With respect to the moisture content, the dielectric constant $\epsilon_w$ of water is 81, as compared with the dielectric constant $\epsilon_B$ of cotton, which is about 4. In other words, the difficulty is to obtain the desired signal directly via the transducer and by using the fiber mass which is in the capacitor at a given time.

According to the present invention, the voltage U is measured across the capacitor 21 and the resulting signal is divided into a real part $R_x$ and an imaginary part $C_x$. Signals $R_x$ and $C_x$ are evaluated in the regulation system, as will be explained more fully hereinafter, and also while taking account of the outlet measurement or measured signal. The difficulties in measurement on the input or inlet side are one reason for constructing the regulation system according to the invention in such a manner that errors in measurement are compensated by adaptive regulation or control.

The outlet measuring element 9.2 can be a conventional measuring instrument which delivers a signal $A_{out}$ containing data or information about the cross-section of the emerging sliver 18'. This signal also is subsequently additionally processed for regulation purposes. The required measurements need not be only made directly at the inlet or outlet. It is only necessary to dispose one measuring element or means in front, that is, in an upstream zone, and one behind, that is, in a downstream zone, with respect to the regulated or controlled system, that is, the main drafting zone 12 in the present case. It would also be advantageous, for example, to dispose the input-side or input-end measuring element 9.1 immediately in front or upstream of the main drafting zone 12, to obtain advantageous time-dependence of the regulation accomplished by the regulation system.

It is assumed that both high-frequency and low-frequency changes or non-uniformities in the sliver need to be corrected, to obtain an optimized regulation. The regulation needs to keep the mean or average value of the sliver substantially constant (the first priority) and also to eliminate irregularities in the sliver. The deviations of the regulated or controlled variables or magnitudes can be detected by the regulation or control system as high-frequency and low-frequency components of the measured variables or magnitudes. The problem as regards measurement technology and automatic regulation or control engineering is to obtain information about these variables or magnitudes and convert them into the desired manipulated or adjustment variable or magnitude. In particular, in the case of high-frequency changes, there must be taken into account the transit time between the measuring element and the final control or adjustment element.

At the inlet side or end, that is, in the case of the inlet measuring element or means 9.1, it is possible to obtain the high-frequency signal components. Due to the dead time of the outlet-side or outlet-end measurement by means of the outlet measuring element or means 9.2, here only the low-frequency components of the signal can be compensated in the regulation or control system. Problems and errors due to measurement technology are now also taken into consideration according to the invention in the regulation or control system, by the fact that the measured or measurement signals from the outlet measuring element or means 9.2 are taken into account for adapting the regulation or control system to errors or other deviations at the inlet end. An identification field or performance characteristic $\mathfrak{R}$, which is determined empirically and continuously adjusted during operation, is provided according to the invention for this purpose.

Figure 3:
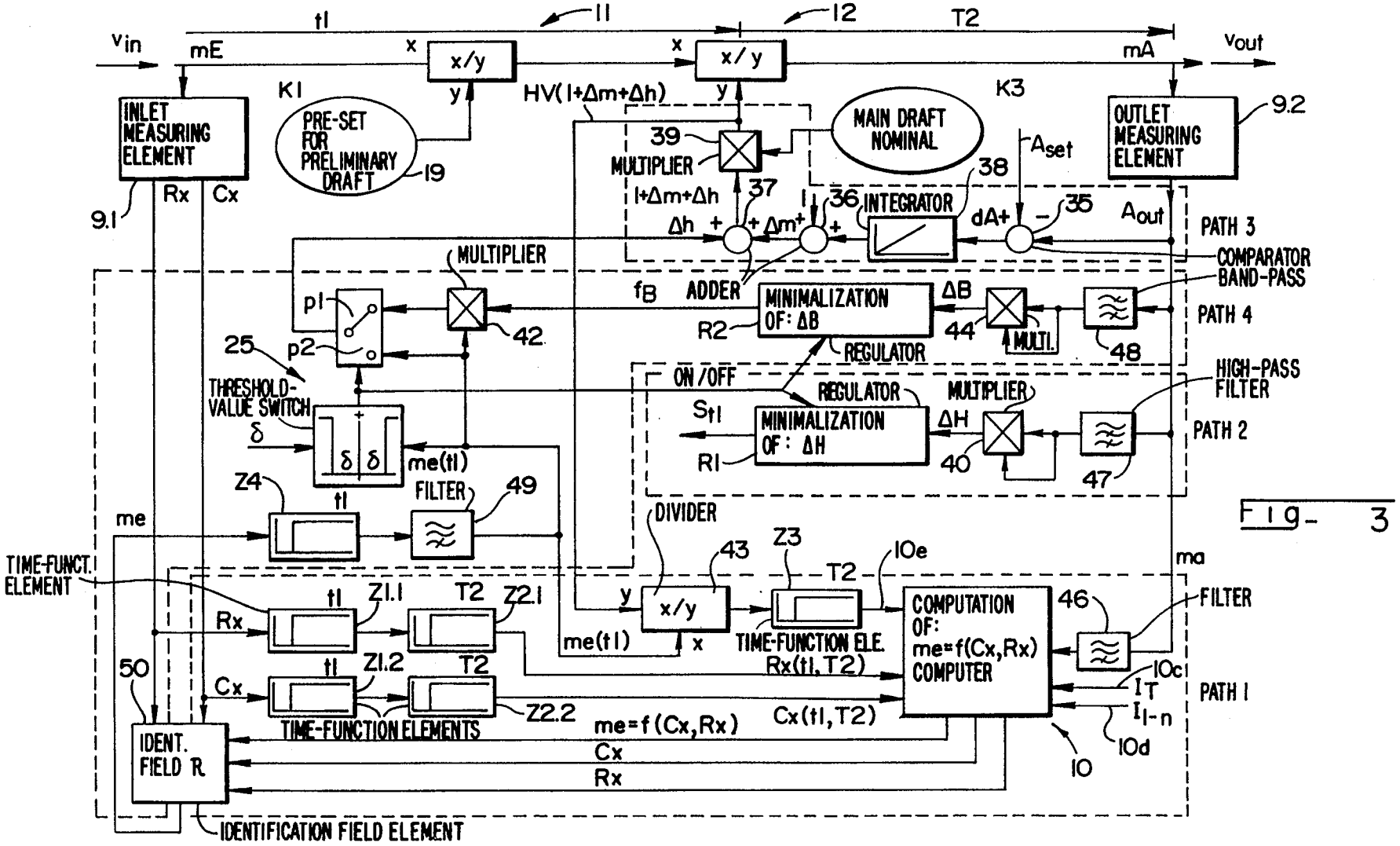
FIG. 3 illustrates the function principle of the method accomplished with the aforementioned commonly assigned, U.S. application Ser. No. 07/566,627, filed Aug. 13, 1990.

FIG. 3 illustrates the regulation or control principle and the method according to the invention, in a schematic diagram of the main regulation or control system. The drafting arrangement is indicated by arrows representing the direction of travel of the sliver, as well as a block 11 for the preliminary draft and a block 12 for the main draft. The actual cross-section $m_E$ of the slivers 15.1 to 15. 6 at the inlet is represented by the variable or magnitude $m_e$, and the actual cross-section $m_A$ of the already finished drafted sliver 18' is represented by the variable or magnitude $m_a$.

The slivers 15.1 to 15.6 are delivered at the inlet at a speed $v_{in}$ and the finished drafted sliver 18' emerges at the outlet at a speed $v_{out}$. The amount of preliminary draft or drafting K1 can be adjusted by a presetting means 19. The regulation path, in terms of the regulation, is formed by the main drafting zone 12 in the present case. The transit time between the inlet measuring element or means 9.1 and the main drafting zone 12 is denoted by reference character t1, and the transit time between the main drafting zone 12 and the outlet measuring element or means 9.2 is denoted by reference character T2. The measured magnitudes or variables $A_{out}$, $R_x$, and $C_x$, measured by measuring elements 9.1 and 9.2, are the input variables or magnitudes to a regulation or control system. The regulation or control system comprises a central computer unit 10 which is supplied with the measured magnitudes or variables $C_x$, $R_x$, the temperature $I_T$ at input 10c and any additional data or information $I_{1-n}$ at input 10d, such as the air humidity, air pressure and so forth. The magnitude or variable $A_{set}$ is set as the guide magnitude or variable.

For clarity, the regulation or control system is divided into a number of "paths" 114 4, depicted by broken lines in the block circuit diagram of FIG. 3. A first path 1 contains the central computer unit 10 with inlet and outlet leads, that is, inputs and outputs, and a number of time function elements Z1.1–Z3 and is used according to the invention for processing measured data. A second path 2 is for optimizing the delay time t1. A third path 3 is for optimizing the process of keeping the sliver mean value constant, and compensating long-term defects. Finally, a fourth path 4 is provided for optimized compensation of short-term defects. The regulation or control system used in the invention is preferably digital, so that all of the components of the regulation or control system can be embodied in a computer. In order to illustrate the regulation or control principle, the essential components necessary for understanding the invention are diagrammatically illustrated in FIG. 3.

Beginning at path 3 (for keeping the sliver mean value constant) a comparator 35 is provided and forms the difference between the output signal $A_{out}$ and the set value $A_{set}$. The thus-determined deviation dA is fed through an I-element 38 to an adder 36. The deviations from the mean value are integrated in I-element 38, forming the signal Am, and unity is added. The deviation is added in a second adder 37 to deviations $\Delta h$ caused by short-term disturbances or defects and determined in path 1 and path 4 as explained hereinafter, and finally the factor $1+\Delta m+\Delta h$ is multiplied in a multiplier 39 by the preset nominal value K3 of the main draft. The corresponding multiplication gives the required adjustment magnitude or manipulated variable y for controlling the main draft.

The outlet measured signal $A_{out}$ is also fed to a high-pass element or filter 47 of path 2. The filtered signal is squared by a multiplier 40 to obtain the signal $\Delta H$, which gives the high-frequency component of the fluctuations in the mean value. In this path 2, account is taken of the high-frequency components, which in this embodiment are up to about 300 Hz. The signal $\Delta H$ is fed to a first regulation or control unit R1 having a transmission function for minimalizing $\Delta H$. The regulation or control element R1 outputs the signal $S_{t1}$, which has an optimizing influence on the delay time of various time function elements Z1.1, Z1.2, Z4 and is directly fed to the central computer unit 10.

According to the invention, the core or salient member connecting path 1 and path 4 is an identification-field or performance characteristic element 50. Identification-field element 50 can, for example, be a read-write memory and can be incorporated in the central computer unit 10. The identification-field element 50 stores a starting or input identification field or performance characteristic $\mathfrak{R}$ empirically determined with respect to the variables $R_x$ and $C_x$ and relates to the magnitude or variable $m_e=f(R_x, C_x)$. The identification-field element 50 is supplied with the measured pairs of values $R_x$, $C_x$ and delivers the magnitude or variable $m_e$ as the output signal.

The identification field or performance characteristic $\mathfrak{R}$ is continuously adjusted during operation, the adjustment being made in path 1. In this embodiment, the signals $R_x$, $C_x$, after being delayed in corresponding time function elements Z1.1–Z2.2, are fed to the central computer unit 10. The time function elements Z1.1–Z2.2 serve to take account of the entire transit time t1+T2 from the inlet measuring element or means 9.1 to the outlet measuring element or means 9.2. The filtered variable $m_{e(t1)}$, after being delayed to allow for the transit time t1 and after being draft-compensated in a divider 43, is supplied via a time function element Z3 to an additional input 10e of the central computer unit 10.

The signal $A_{out}$, containing information or data about the outlet sliver cross-section $m_A$ represented by the measured magnitude or variable $m_a$, is preferably likewise filtered prior to being delivered to the central computer unit 10. The low-frequency signal components are clipped in a suitable filter 46 in path 1. Instead of using time function elements Z1.1–Z3, the transit time t1 can alternatively be taken directly into account by the central computer unit 10, by feeding thereto the output signal $S_{t1}$ in path 2.

All of the signals delivered to the central computer unit 10 are subsequently used for correcting the identification field or performance characteristic $\mathfrak{R}$ of identification-field element 50, for which purpose the ("effective") magnitude or variable $m_e$ relating to the respective pair of values $C_x$, $R_x$, and obtained by evaluating the measured data, constitute the output of the central computer unit 10 and are transmitted to the identification-field element 50. As a result, the identification field $\mathfrak{R}$ is permanently adapted to changes within the regulation or control process. As can be seen, the central computer unit 10 must evaluate at least the signals $m_e$, $R_x$, $C_x$, $m_a$ in order to ensure that the identification field $\mathfrak{R}$ is adapted. Under certain conditions, however, the aforementioned additional measurement data $I_T$, $I_{1-n}$ can be used for further improvement of the regulation or control.

In path 4, as in path 2, the signal $A_{out}$ is filtered, but this time by a band-pass element or filter 48 instead of a high-pass element or filter. The band-pass element 48 is followed by a multiplier 44 and a regulation or control unit R2 for minirealizing the corresponding signal $\Delta B$. The regulation or control unit R2 outputs a factor $f_B$ which is multiplied by the signal $m_{e(t1)}$ in a multiplier 42. The signal $m_{e(t1)}$ appears at the output of a filter 49, to which the signal $m_e$ from the identification-field element 50 is supplied via the time function element Z4. Filter 49 clips the low-frequency components of the signal. Path 4 also contains a threshold-value switch 25 having an adjustable preset value $\delta$ to both sides of the mean value. If the signal $m_{e(t1)}$ is below the preset value $\delta$, that is, within the tolerance band or limits about the mean value, then the threshold-value switch 25 will be in a first position p1. As soon as the preset value $\delta$ is exceeded in the one or other direction, that is, $m_e$ fluctuates widely around the mean value, the threshold-value switch 25 changes to a position p2 at which the signal $m_{e(t1)}$ travels directly to path 3, so that these fluctuations are fully taken into account for the main draft.

If, however, the values for $m_{e(t1)}$ are below the preset value $\delta$, then path 4 is used for optimization. The signal $m_{e(t1)}$ is multiplied in multiplier 42 by the factor $f_B$ determined by means of the minimalization function of the regulation or control unit R2, and the output signal from the multiplier 42 is supplied to path 3 via the threshold-value switch 25. The switching-over by means of the threshold-value switch 25 and the optimization which is taken into account by the regulation or control unit R2, serves to prevent any disturbances caused, for example, by noise from being introduced into path 3 during small or very small temporary deviations from the mean value.

The threshold-value switch 25 is also used for switching on or off the optimization by the regulation or control units R1 and R2. Optimization by the regulation or control units R1 and R2 is switched off if $m_e$ is above the preset value $\delta$, and switched on otherwise. It is not absolutely necessary to switch off the optimization by the regulation or control units R1 and R2 if the preset value $\delta$ is exceeded, but running away of the corresponding regulation or control also can be achieved by compensation elements. In a digital regulation or control system, however, switching the corresponding regulators or controls on and off is very simple, so that this variant is preferred. After switching-off the optimization by the regulator or controller R1 the last switched-in time-delay t1 remains unchanged until renewed switching-in of the optimization by the regulator or controller R1.

The threshold-value switch 25 can also be embodied by a non-linear device or can be incorporated in the identification field or performance characteristic $\mathfrak{R}$. In the latter case the identification-field or performance characteristic element 50 delivers both the output variable $m_e$ and also the required signal for activating or deactivating the optimization by regulation or control units R1 and R2, or delivers a parameter dependent on amplitude.

In the present embodiment, the high-pass element or filter in path 2 can filter, for example, frequencies above 100 Hz, whereas the band-pass element or filter can filter frequencies in the range from 10 to 100 Hz. The frequency ranges depend on the transit speeds of the slivers, which in the present case are assumed to be in the range of about 600 meters per minute.

It is to be observed that the transmission functions of the regulation or control units R1 and R2 can vary with the construction of the regulation or control system. In a preferred embodiment of the invention, the filters in paths 2 and 4 can be omitted and the transmission functions can be determined in a manner which takes the frequencies in question into account in the required manner. Of course, the filter 46 in path 1 also can be omitted and filtering can be carried out by the central computer unit 10. Another advantage of being able to alter the parameters of the corresponding transmission functions is ease of adaptation to different operating conditions (for example, variations in the throughput speed of the slivers).

In this connection, a specific embodiment comprises adaptive adjustment of the regulation or control parameters. The parameters of the transmission functions of the regulation or control units R1 and R2 are altered during the regulation or control, so that the variations of the adjustment magnitude or manipulated variable are minimized. In this embodiment, the parameters of the transmission functions are determined by the central computer unit 10, using the measured magnitudes or quantities. In adaptive regulation or control, great stress must be laid on stability, which can be realized by appropriate determination of the corner values of the identification field or performance characteristic.

The central computer unit 10 is preferably a digital computing apparatus. Of course, the functions of the various paths 1–4 explicitly shown in FIG. 3 for explaining the principle of operation can be partly or completely integrated in a single computer.

The starting identification field or performance characteristic $\mathfrak{R}$ for $m_e$ can be obtained, for example, by static measurements at the measuring capacitor 21 and then stored in the form of a table. It is to be noted that other identification fields or performance characteristics have to be determined if the method of measurement is varied. Accordingly, the inventive principle can be applied to other inlet and outlet measuring elements, using corresponding identification fields or performance characteristics.

The regulation or control principle according to the invention ensures excellent homogenizing or equalization even if there are unforeseen changes in operating conditions. More particularly, measuring errors on the inlet side are also compensated by the regulation or control. Short-term defects and also slow changes can both be compensated in optimum manner by the regulation or control. If the aforementioned method is used for the main regulation or control of the drafting unit in conjunction with the auxiliary regulation or control of the independent drive groups and a corresponding interlinked regulation or control is provided, the conditions are particularly advantageous. Accordingly, the adjustment magnitude or manipulated variable y determined by the main regulation or control is used as a set value for the regulator or controller 8.2 of the drive for the main drafting zone 12.

By way of completeness it is here remarked, the methods and regulation or control according to the invention are suitable for all devices in the textile industry which require regulation or control of a drafting unit, and are not limited to the draw frame mentioned in the description.

Figure 4:
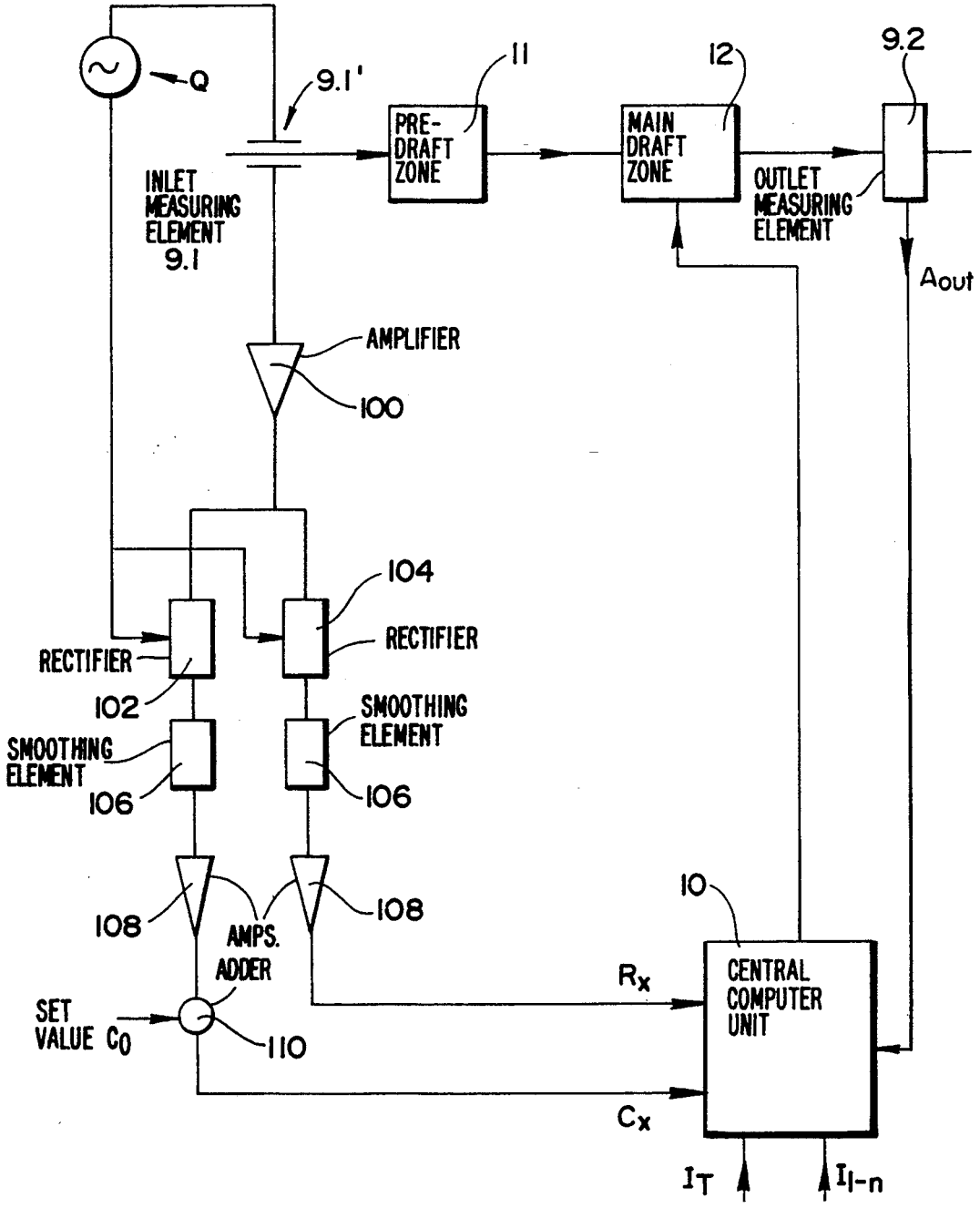
FIG. 4 depicts in block circuit diagram a simplified version of the method accomplished with the structure depicted in FIG. 3.
Figure 4A:
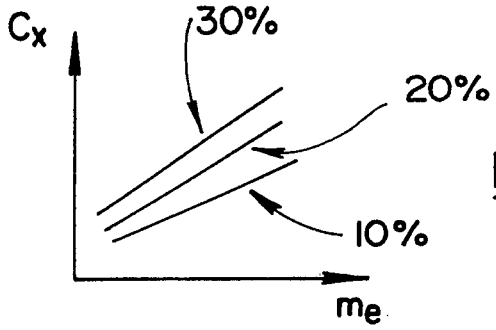
FIGS. 4A and 4B are respective diagrams for explaining evaluation of the signal delivered by the inlet measuring element.

Based upon the block circuit diagram of FIG. 4 and the diagrams or curves of FIGS. 4A and 4B there will be explained different operations of the arrangement of FIG. 3. FIG. 4 illustrates a simplified version of FIG. 3. Once again FIG. 4 depicts the inlet measuring element or means 9.1 and the outlet measuring element or means 9.2, the preliminary drafting or pre-draft zone 11, the main drafting zone 12 and the central computer unit 10 with its inputs for the signals $R_x$, $C_x$, $A_{set}$, $A_{out}$, $1_t$ and $1_{i-n}$. This FIG. 4 underscores the fact that all regulation operations are realized in the computer software, that is, the "elements" of the paths 1, 2, 3 and 4 of FIG. 3 constitute aspects of the programming of the central computer unit 10.

The operations, now to be more fully explained, are the following:

1. The formation and adaptation or adjusting of an identification field or performance characteristic $\mathfrak{R}$, and 2. The splitting of the output signal of the measuring element 9.1 into its components $R_x$ and $C_x$.

The magnitude $m_e$ should represent the mass of the fibers located in the measuring field or region of the inlet measuring element 9.1. The individual signal components $R_x$ and $C_x$ do not correspond to this mass magnitude $m_e$ because they are dependent upon at least one further variable (the "parameter"). However, it is possible to determine for this important parameter a "family" of curves representative of the course of both of the individual signal components $R_x$ and $C_x$ as a function of the fiber mass, that is, as a function of the magnitude $m_e$ for random selected values of the parameter. This has been depicted in the diagram (signal component $C_x$) of FIG. 4A and in the diagram (signal component $R_x$) of FIG. 4B, and there is not of concern the exact course or pattern of the characteristic, rather only the representation of the principle. The parameter is the moisture content or humidity of the sliver which can be, for example, represented as a percentage of the fiber mass. Purely by way of example, FIGS. 4A and 4B each respectively show three characteristics, namely, a characteristic for 10% water, one for 20% water and the remaining one for 30% water.

Figure 4B:
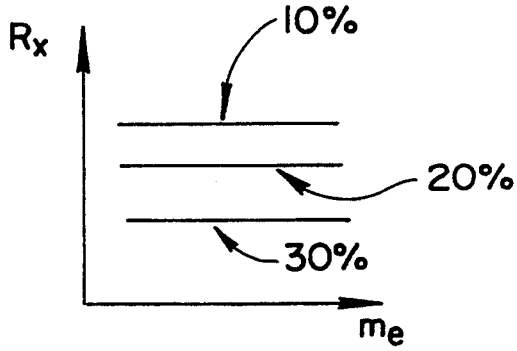

What is significant is the change of the signal components $C_x$ primarily as a function of the water content and with altered fiber mass the signal component $R_x$ remains practically constant (FIG. 4B shows horizontal "curves" which is not quite true in actual practice, but can be assumed to be so as a good approximation).

This means that every random value of $m_e$ (the fiber mass in the measuring field) can be unambiguously correlated with a signal component pair $R_x$ and $C_x$. The "real" signal component $R_x$ affords a "selection" among the "curves" of FIG. 4A, so that the "imaginary" signal component $C_x$ can be exploited for determining the fiber mass (the magnitude $m_e$) based upon the relevant characteristic.

During the formation of the identification field or performance characteristic $\mathfrak{R}$ there are accordingly inserted (read into a storage or memory of the central computer unit 10) individual correlations of empirically determined signal component pairs $R_x$ and $C_x$ to known fiber masses, more precisely, known fiber- and water masses, in the identification field $\mathfrak{R}$. A theoretically computed "model" of the identification field $\mathfrak{R}$ then enables the extrapolation of the empirically determined values in order to form a sufficiently extensive and detailed identification field $\mathfrak{R}$ (as a first approximation), so as to cover the desired working or operating region (fiber mass and water content) with the desired precision. The regulation or control system now can work (however, not optimized) with this identification field $\mathfrak{R}$ which has been derived partially theoretically, partially empirically.

Prior to correcting the identification field or performance characteristic $\mathfrak{R}$, as will be more fully considered hereinafter, the system will not optimumly function, since the identification field $\mathfrak{R}$, which has been derived for the most part theoretically, hardly corresponds to practical conditions. During correction of the identification field $\mathfrak{R}$, the signal component pairs $R_x$ and $C_x$ must be correlated to the fiber masses which are relevant in practice and the identification field $\mathfrak{R}$ must be correspondingly corrected. This is possible since the outlet measuring element or means 9.2 has a different construction than that of the inlet measuring element or means 9.1 and responds directly to the fiber mass (or the cross-section of the sliver). A preferred construction of outlet measuring element means comprises a feeler roll pair, for instance, as disclosed in the commonly assigned U.S. Pat. No. 4,539,729, granted Sep. 10, 1985, to which reference may be readily had and the disclosure of which is incorporated in its entirety herein by reference.

During the correction of the identification fields $\mathfrak{R}$, that is, during the new correlation of the signal component pairs $R_x$ and $C_x$ to their magnitudes $m_e$, it is important, however, to not only take into account the time delay between the measurements at the inlet measuring element 9.1 and the outlet measuring element 9.2 but also the processing of the sliver between these two measuring elements 9.1 and 9.2 in the drafting arrangement of the textile machine. There can be assumed a constant preliminary draft K1 (FIG. 3) which can be inputted into the central computer unit 10 as a machine setting. With constant delivery velocity or speed (rotational speed of the delivery rolls), a constant throughput time $T_2$ from the drafting arrangement to the outlet measuring element 9.2, also can be assumed. In order to obtain the desired equalization or homogenizing of the fiber mass per unit length of the sliver, it is, however, necessary to alter in a controlled manner the rotational velocity or speed of the inlet rolls until entry into the main drafting zone 12, with attendant alteration of the main draft and the throughput time of the sliver from the inlet measuring element 9.1 into the main drafting zone 12.

During the correction of the identification field or performance characteristic $\mathfrak{R}$ of FIG. 3, there is accordingly correlated a signal component pair $R_x$ and $C_x$ to an instantaneous value of the fiber mass in the delivered sliver momentarily determined by the inlet measuring element 9.1. This value has been produced by the inlet measuring element 9.1 a short predetermined time before. This correlation is possible by taking into account the time delays $t_1$ and $T_2$. During the correction of the identification field $\mathfrak{R}$ there is not of interest, however, the fiber mass in the delivered sliver, rather the corresponding fiber mass in the feed or supply sliver which can be reconstructed by considering the drafting operation exerted upon the feed or supply sliver. This reconstructed value of the fiber mass in the feed sliver is correlated, as the magnitude $m_e$ in the identification field $\mathfrak{R}$ to the relevant signal component pair $R_x$ and $C_x$, and there is erased the original (theoretical) computed value of the magnitude $m_e$ for this signal component pair $R_x$ and $C_x$.

After a certain period of "experience", the regulation or control system has formed in this manner its own identification field or performance characteristic $\mathfrak{R}$ which has been tailored thereto and can correspondingly operate in an optimized fashion. However, by virtue of the foregoing there has only been taken into account a single "disturbance factor", namely, the water or moisture content of the sliver. In actual practice there are present further predictable and non-predictable disturbances. Belonging to such disturbances are, for example, changes in the air humidity which affect draftability of the sliver and the delivery velocity or speed which can influence the behavior of the regulation or control system or circuit. In those situations where there are to be expected considerable changes, it can be advantageous to define the changeable variables as "parameter" and for different values of this parameter to form a respective identification field or performance characteristic. There is then switched over from one identification field or performance characteristic to the other as a function of, for example, a signal at the input carrying the previously mentioned data $1_{1-n}$ or as a function of the setting of the delivery velocity.

However, not all of the influences of the different disturbances are predictable. The regulation or control system will be affected due to aging of the inlet measuring element 9.1 or the outlet measuring element 9.2 or the drafting rolls, so that the behavior of the regulation or control system changes with time. A change in the type of textile material undergoing processing also can result in a change in the behavior of the regulation or control system. However, such changes can be taken into account through continual adjustment or correction of the identification field or performance characteristic $\mathfrak{R}$.

What is here important is that the inlet measuring element 9.1 delivers two signal components $R_x$ and $C_x$ which can be unambiguously correlated as a pair to a predeterminable fiber mass and that this determination can be accomplished based upon the signal delivered by the outlet measuring element and known or determinable parameters of the regulated system.

The division of the signal of the inlet measuring element 9.1 into its real part or component $R_x$ and its imaginary part or component $C_x$, constitutes an important aspect of the present invention. Therefore, FIG. 4 illustrates a possibility of realizing this signal division.

In the arrangement of FIG. 4, the inlet measuring element or means 9.1 comprises a capacitor 9.1', an amplifier 100 and two rectifiers or rectifier units 102 and 104, each equipped with a smoothing element 106 and an amplifier 108. A suitable alternating-current source Q delivers electrical energy at a suitable frequency to the capacitor 9.1' and also to the rectifiers 102 and 104. One of the rectifiers 102 and 104, here the rectifier 102 is powered in-phase and the other rectifier 104 90° out-of-phase with respect to the capacitor 9.1'.

The rectifier 104 delivers a signal representative of $1/R_x$ and the other rectifier 102 delivers a signal to an adder or addition element 110 where such signal is combined with a set or reference value Co corresponding to the capacitance of the "empty" capacitor 9.1', that is when there is not present a sliver. The output line of the adder 110 carries the signal $C_x$ in the form of deviations with respect to the set or reference value Co.

Up to now the description has focussed upon advantages of the new and improved regulation or control system of the present development which arise in conjunction with the "admixing" of a disturbance or spurious material, here water or moisture in the sliver. Even then when the sliver to be scanned or monitored only contains fibers (and air), the inventive system can provide an additional advantage, namely, when the inlet measuring element or means can not deliver absolute values, only relative results. This is the case, for instance, where, as in FIG. 2, the inlet measuring element is constructed as a capacitor.

Such a measuring element is quite practical in those instance where it is necessary to monitor fiber material in the form of a web or fleece. However, this type of measuring element previously had the drawback that it was not able to indicate the fiber quantity, rather only fluctuations in such fiber quantity. Yet, by calibrating the inlet measuring element based upon the measurement results obtained by the outlet measuring element, it is now possible to also obtain by means of the inlet measuring element absolute values of the fiber mass in the form of the magnitude $m_e$. Of course, as a prerequisite for the foregoing, it is necessary to adapt the identification field or performance characteristic to the encountered conditions.

The outlet measuring element or means 9.2 plays an important role both in terms of the regulation (path 3 of FIG. 3) for maintaining constant the mean value of the delivered sliver as well as also for the regulation or control (paths 1, 2 and 4 of FIG. 3) for equalizing short-wave mass fluctuations. Although the inlet measuring element 9.1 must be responsive to a web (FIG. 2), the outlet measuring element 9.2 can be placed at a measuring location following the condensing or gathering of the drafted web into a sliver (in the condenser or funnel T of FIG. 1).

As a result, it is possible to provide at the outlet a pair of feeler or sensor rolls responsive to the cross-section of the delivered sliver. A pair of feeler or sensor rolls is practically insensitive to the water or moisture content of a sliver. This type of measuring transducer therefore is extremely well suited to suppress by means of the identification field the measurement errors caused by the water or moisture content of the sliver at the inlet measuring element. However, a measuring sensor responsive to the cross-section of the sliver, is prone to its inherent measuring errors, which also must be taken into account. During measuring of the sliver cross-section, the primary error which arises is caused by the air entrained by the fibers in the interior of the sliver.

In this regard, it is important to recognize that a constant measuring error is neither detrimental for the regulation system nor for the regulation. Difficulties only then arise if the measuring error is subjected to unforeseen fluctuations which then can trigger faulty reaction of the regulation or control system.

Charges in the packing density of the fibers of the sliver, that is, changes in the space present between the fibers, are responsible for fluctuations in the quantity of entrained air. The quantity of air in the sliver during the measurement operation, is also dependent upon how much air is expressed or squeezed out during compression of the sliver. Both the packing density of the fibers of the sliver and the resistance opposing the squeezing out of the air, essentially depend upon the degree of parallelization of the fibers. This degree of parallelization of the fibers of a sliver delivered by a drafting arrangement depends, on the one hand, upon the degree of parallelization of the fibers of the feed material and, on the other hand, upon the draft performed in the drafting arrangement. Since the draft continually changes in an autoleveller drafting arrangement, there is to be expected a variable packing density of the fibers in the delivered sliver, and thus, a variable proportion of air throughout the cross-section of the sliver.

An even more pronounced effect can be determined in the event of sliver rupture at the inlet or input side of the drafting arrangement. This results in a corresponding reduction in the draft, and thus, to a reduced degree of parallelization of the fibers. More space is available in the sliver for the entrainment of air and the feeler roller pair squeezes a smaller proportion of the entrained air out of the sliver. The measurement of the "fiber quantity" at the feeler roller pair, responsive to the cross-section of the sliver, is accordingly too high.

Accordingly, at least when confronted with appreciable changes in the drafting of the sliver, there should be undertaken a correction of the output signal delivered by the outlet measuring element or means, in order to eliminate the effects of the variations in the degree of drafting upon the signal level. This can be readily accomplished by the central computer unit 10 (FIGS. 3 and 4), because this central computer unit 10 receives corresponding data or information concerning the degree or level of the drafting operation with a suitable time delay performed by the time function element Z3 of FIG. 3.

Figure 5:
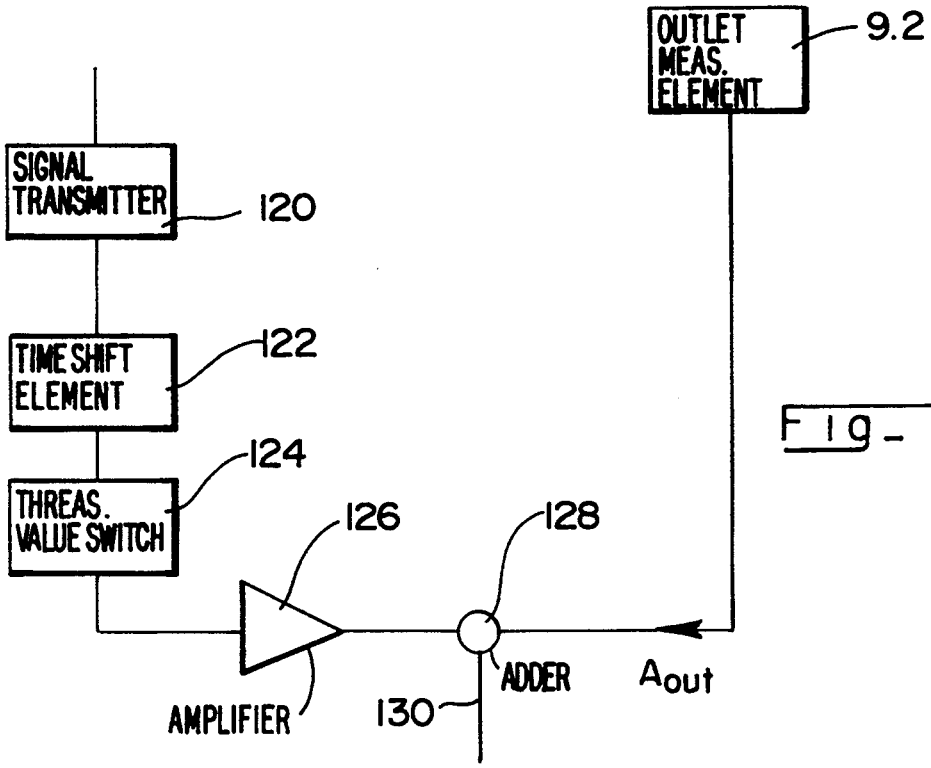
FIG. 5 is a block circuit diagram of the system for taking into account possible measuring errors at the outlet measuring element.

It will hardly be necessary to accommodate the signal $A_{out}$ to each small draft change or variation. However, an accommodation or adjustment of the signal $A_{out}$ can be at least undertaken when the feed material experiences a relatively high draft, for example, following sliver rupture at the inlet side or end of the drafting arrangement. FIG. 5 schematically illustrates a "hardware" solution, which also can be realized by appropriately programming the central computer unit 10. This proposal encompasses a "signal transmitter" 120, for example, the element 43 of FIG. 3, which delivers a signal dependent upon the drafting operation to a time-shift element 122, for instance, the element Z3 of the arrangement of FIG. 3. The time-shifted or time-displaced signal is delivered to a threshold-value switch 124, so that upon exceeding the threshold value, corresponding to a predetermined degree of drafting or drafting level, there is further delivered a correction signal via an amplifier 126 to an adder or addition element 128.

This adder 128 also receives the output signal $A_{out}$ of the outlet measuring element or means 9.2 and adds this signal to the correction signal when the latter is received by the amplifier 126. The result is delivered by the output 130 to the paths 1, 2, 3 and 4 for evaluation. In the event there is not generated any correction signal, because the threshold determined by the threshold-value switch 124 has not been exceeded, then the adder 128 simply further delivers the output signal $A_{out}$, without correction, by means of the output 130.

As previously mentioned, the degree of parallelization of the fibers in the delivered sliver is not only dependent upon the drafting which has been carried out, but also upon the degree of parallelization of the fibers in the feed material. Such continually increases in the spinning or processing line from the card to the end spinning operation. The correction of the output signal of the outlet measuring element or means 9.2 becomes correspondingly more important the earlier that the autoleveller drafting arrangement is incorporated into the processing line; and a suitable correction is also dependent upon this "environmental factor". Therefore, in practice, it is advantageous to use as the amplifier 126 an adjustable amplifier, so that at this location of the processing line there can be accommodated the correction signal.

Use of the threshold-value switch 124 is not absolutely necessary. A signal dependent upon the degree of drafting can be continuously delivered to the amplifier 126, so that the output signal $A_{out}$ is always corrected as a function of the degree of drafting. Also, two or more threshold values could be defined, which initiate different corrections and these corrections are constituted by known empirical values.

A further problem in evaluating the output signal delivered by the outlet measuring element is constituted by the previously mentioned squeezing out or expulsion of the entrapped air during the measuring operation or method. This effect is also dependent upon the delivery velocity of the sliver. The greater such delivery velocity the less the amount of entrapped air which can be expressed from the sliver by the roll pair of the outlet measuring element. Therefore, an increase in the delivery velocity of the sliver results in an apparent reduction in the sliver cross-section (the fiber mass).

With constant delivery velocity during operation an error should not occur for this reason. However, upon stopping or run-up-to-speed of the drafting arrangement the measuring results or values of the outlet measuring element or means are thus falsified. In the case of a drafting arrangement having changeable delivery velocities of the sliver for accommodation of the draft to fluctuations in the fiber mass, in the presence of high draft changes also during normal operation, there can be caused a false or erroneous evaluation.

It is possible to prevent such erroneous evaluation by correcting the output signal of the outlet measuring element as a function of the instantaneous delivery velocity (at least during stopping or run-up-to-speed of the drafting arrangement). The correction is not shown in detail in FIG. 5, since it essentially can be accomplished in the manner of the illustrated and considered draft correction. Here, the correction signal is, of course, not derived from the draft, rather from the delivery velocity of the sliver and is furnished to a suitable location, for instance, to the adder 128 where it can be combined with the output signal of the outlet measuring element 9.2.

In conjunction with the outlet measuring element there is not possible an automatic optimization by checking the results, because the outlet measuring element itself constitutes the last control of the obtained results. Therefore, it becomes increasingly important that there are corrected at this location falsifications of the signal. Optimization of the correction can be empirically undertaken by the operating personnel.

While there are shown and described present preferred embodiments of the invention, it is distinctly to be understood the invention is not limited thereto, but may be otherwise variously embodied and practiced within the scope of the following claims.

What is claimed is:

1. An autoleveller drafting arrangement for slivers having an inlet side and an outlet side, comprising:

drafting means providing at least one drafting zone for drafting textile material originating from at least one feed sliver to form a drafted sliver;

drive means for driving the drafting means in the at least one drafting zone;

an outlet side measuring element for measuring a mass characteristic of the drafted sliver and for delivering a measurement signal resulting from the measuring of the drafted sliver in order to provide a measurement result;

regulation means for regulating the drive means;

the regulation means being operatively connected to the outlet side measuring element and responsive to the measurement signal delivered thereto by the outlet side measuring element for regulating the drive means such that the drafting of the sliver in the at least one drafting zone is adjustable in such a manner that mass fluctuations in the drafted sliver are corrected; and said regulation means adjusting the measurement signal received thereby from the outlet side measuring element as a function of at least one operational parameter prevailing at the drafting zone in order to compensate for effects exerted upon the measurement result due to the at least one operational parameter.

2. The autoleveller drafting arrangement according to claim 1, wherein:

the at least one operational parameter comprises a degree of drafting exerted upon a section of the drafted sliver which is being measured; and the regulation means comprising means for adjusting the measurement signal of the outlet side measuring element as a function of said degree of drafting.

3. The autoleveller drafting arrangement according to claim 2, wherein:

said drafting means in the at least one drafting zone comprises means for delivering the drafted sliver at a predetermined delivery velocity;

the at least one operational parameter comprises the predetermined delivery velocity of the drafted sliver; and the regulation means comprising means for adjusting the measurement signal of the outlet side measuring element as a function of said predetermined delivery velocity of the drafted sliver.

4. The autoleveller drafting arrangement according to claim 1, wherein:

said drafting means in the at least one drafting zone comprises means for delivering the drafted sliver at a predetermined delivery velocity;

the at least one operational parameter comprises the predetermined delivery velocity of the drafter sliver; and the regulation means comprising means for adjusting the measurement signal of the outlet side measuring element as a function of said predetermined delivery velocity of the drafted sliver.

5. The autoleveller drafting arrangement according to claim 1, wherein:

the outlet side measuring element for measuring the drafted sliver and for delivering a measurement signal resulting from the measuring of the drafted sliver comprises means for measuring a cross-section of drafted sliver exiting the at least one drafting zone.

6. An autoleveller drafting arrangement for slivers having an inlet side and an outlet side, comprising:

an inlet side measuring element for measuring the mass of textile material delivered to the inlet side of the drafting arrangement and a quantity of at least one medium entrained by the textile material;

drafting providing at least one drafting zone for drafting textile material provided by at least one feed sliver in order to form a drafted sliver;

an outlet side measuring element for measuring a quantity of fibers of the drafted sliver drafted by the drafting means in the at least one drafting zone;

the outlet side measuring element being non-responsive to the medium entrained by the textile material;

drive means for driving the drafting means in the at least one drafting zone;

regulation means for regulating the drive means;

the regulation means being operatively connected to the inlet side measuring element and the outlet side measuring element and responsive to measurement signals delivered thereto by the inlet side measuring element and the outlet side measuring element for regulating the drive means such that the drafting of the textile material in the drafting zone is adjustable in such a manner that fluctuations in the mass of the textile material passing through the inlet side measuring element are reduced;

means for receiving from the inlet side measuring element a measurement signal comprising two signal components composed of respective signal component pairs;

each respective signal component pair being unambiguously correlatable to a predeterminable quantity of fibers of the textile material; and means for correlating signal component pairs to quantities of fibers of the drafted sliver measured by the outlet side measuring element said correlating means being responsive to a drafting action of the at least one drafting zone upon the mass of the fibers of the textile material drafted between the inlet side measuring element and the outlet side measuring element.

7. The autoleveller drafting arrangement according to claim 6, wherein:

the outlet side measuring element for measuring the quantity of fibers drafted by the drafting means in the at least one drafting zone delivers a measurement signal resulting from the measuring of the drafted sliver in order to provide a measurement result;

said regulation means adjusts the measurement signal received thereby from the outlet side measuring element as a function of at least one operational parameter prevailing at the drafting zone in order to compensate for effects exerted upon the measurement result due to the at least one operating condition; and the quantity of fibers of the drafted sliver which has been drafted by the drafting means in the at least one drafting zone as measured by the outlet side measuring element first being determined following said adjustment of the measurement signal of the outlet side measuring element.

8. The autoleveller drafting arrangement according to claim 7, wherein:

the at least one operational parameter comprises a degree of drafting exerted upon a section of the drafted sliver which is being measured; and the regulation means comprising means for adjusting the measurement signal of the outlet side measuring element as a function of said degree of drafting.

9. The autoleveller drafting arrangement according to claim 8, wherein:

said drafting means in the at least one drafting zone comprises means for delivering the drafted sliver at a predetermined delivery velocity;

the at least one operational parameter comprises a further operating condition constituted by the predetermined delivery velocity of the drafted sliver; and the regulation means comprising means for adjusting the measurement signal of the outlet side measuring element as a function of said predetermined delivery velocity of the drafted sliver.

10. The autoleveller drafting arrangement according to claim 7, wherein:

said the drafting means in the at least one drafting zone comprises means for delivering the drafted sliver at a predetermined delivery velocity;

the at least one operational parameter comprises the predetermined delivery velocity of the drafted sliver; and the regulation means comprising means for adjusting the measurement signal of the outlet side measuring element as a function of said predetermined delivery velocity of the drafted sliver.

11. The autoleveller drafting arrangement according to claim 6, wherein:

the quantity of the at least one medium entrained by the textile material measured by the inlet side measuring element comprises the moisture content of the textile material.

12. The autoleveller drafting arrangement according to claim 6, wherein:

the quantity of the at least one medium entrained by the textile material measured by the inlet measuring element comprises air entrained by the textile material.

13. A method of operating an autoleveller drafting arrangement for textile material having an inlet side an outlet side, comprising the steps of:

drafting textile material in at least one drafting zone to form a drafted sliver;

measuring a mass characteristic of the drafted sliver by means of an outlet side measuring element and delivering a measurement signal resulting from the measuring of the drafted sliver in order to provide a measurement result;

regulating a drive means driving a drafting means in the at least one drafting zone by regulation means operatively connected to the outlet side measuring element and responsive to the measurement signal delivered by the outlet side measuring element such that the drafting of the textile material in the drafting zone is adjustable in such a manner that mass fluctuations in the textile material are corrected; and adjusting the measurement signal delivered from the outlet side measuring element by the regulation means as a function of at least one operational parameter prevailing at the drafting zone in order to compensate for effects exerted upon the measurement result due to the at least one operating condition.

14. The method of operating an autoleveller drafting arrangement according to claim 13, further including the steps of:

defining as the at least one operational parameter a degree of drafting exerted upon a section of the drafted sliver which is being measured; and adjusting the measurement signal delivered from the outlet side measuring element by means of the regulation means a function of said degree of drafting.

15. The method of operating an autoleveller drafting arrangement according to claim 14, further including the steps of:

defining as the at least one operational parameter a further operating condition constituted by a predetermined delivery velocity of the drafted sliver from the at least one drafting zone; and adjusting the measurement signal delivered from the outlet side meaning element by means of the regulation means as a function of said predetermined delivery velocity of the drafted sliver.

16. The method of operating an autoleveller drafting arrangement according to claim 13, further including the steps of:

defining as the at least one operational parameter a predetermined delivery velocity of the drafted sliver from the at least one drafting zone; and adjusting the measurement signal delivered from the outlet side measuring element by means of the regulation means as a function of said predetermined delivery velocity of the drafted sliver.

17. A method of operating an autoleveller drafting arrangement for slivers having an inlet side and an outlet side, comprising the steps of:

drafting textile material in at least one drafting zone to form a drafted sliver;

providing an outlet side measuring element for measuring characteristics of the drafted sliver and delivering an output measurement signal representative of a fiber mass of the drafted sliver and air entrained by the fiber mass of the drafted sliver;

regulating a drive means driving a drafting means in the at least one drafting zone by regulation means responsive to the output measurement signal delivered by the outlet side measuring element such that the drafting of the textile material in the drafting zone is adjustable in such a manner that mass fluctuations in the textile material are corrected;

adjusting the output measurement signal delivered from the outlet side measuring element by the regulation means as a function of at least one operational parameter prevailing at the drafting zone in order to compensate for effects exerted upon measurement results of the outlet side measuring element due to the at least one operating condition; and executing the step of adjusting the output measurement signal of the outlet side measuring element as a function of at least one operational parameter prevailing at the drafting zone prior to the measuring step executed by the outlet side measuring element and delivering the output measurement signal representative of the fiber mass of the drafted sliver and the air entrained by the fiber mass of the drafted sliver.

18. A method of operating an autoleveller drafting arrangement for slivers having an inlet side and an outlet side, comprising the steps of:

passing textile material through an inlet side measuring element measuring a fiber quantity of the textile material delivered to the inlet side of the drafting arrangement;

obtaining from the inlet side measuring element a measurement signal comprising two signal components composed of respective signal component pairs;

each respective signal component pair being unambiguously correlatable to a predeterminable quantity of fibers of the textile material;

drafting the textile material in at least one drafting zone to form a drafted sliver;

measuring the drafted sliver by means of an outlet side measuring element and obtaining a measurement signal resulting from the measuring of the draft sliver in order to provide a measurement result; and correlating the signal component pairs to quantities of fibers of the drafted sliver measured by the outlet side measuring element said correlating means being responsive to a drafting action of the at least one drafting zone upon the mass of the fibers of the textile material drafted between the inlet side measuring element and the outlet side measuring element.

19. The method of operating an autoleveller drafting arrangement according to claim 18, further including the steps of:

regulating a drive means driving a drafting means in the at least one drafting zone by regulation means operatively connected to the outlet side measuring element and responsive to the measurement signal delivered by the outlet side measuring element such that the drafting of the textile material in the drafting zone is adjustable in such a manner that mass fluctuations in the textile material are corrected; and adjusting the measurement signal delivered from the outlet side measuring element by the regulation means as a function of at least one operational parameter prevailing at the drafting zone in order to compensate for effects exerted upon the measurement result due to the at least one operational parameter.

* * * * *